United States Patent [19]

DeHart et al.

[11] Patent Number: 4,714,009

[45] Date of Patent: Dec. 22, 1987

[54] CEILING AIR DIFFUSER

[75] Inventors: Marvin L. DeHart, Mesquite; Dale B. Johnson, Garland, both of Tex.

[73] Assignee: Philips Industries Inc., Dayton, Ohio

[21] Appl. No.: 892,292

[22] Filed: Aug. 4, 1986

[51] Int. Cl.[4] ..... F24F 13/06

[52] U.S. Cl. ..... 98/40.13; 98/40.21

[58] Field of Search ..... 98/40.13, 40.21, 40.23, 98/40.05

[56] References Cited

U.S. PATENT DOCUMENTS

| | | | |
|---|---|---|---|
| D. 179,847 | 3/1957 | Griner | 62/4 |
| 1,982,747 | 12/1934 | Kurth . | |
| 2,125,454 | 8/1938 | Marshall | 98/40.13 |
| 2,269,376 | 1/1942 | O'Day | 98/40 |
| 2,326,858 | 8/1943 | Honerkamp et al. | 98/40 |
| 2,772,624 | 12/1956 | Carnes | 98/40.23 |
| 2,791,170 | 5/1957 | Phillips et al. | 98/40 |
| 2,804,007 | 8/1957 | Kurth | 98/40 |
| 2,837,990 | 6/1958 | Tutt | 98/40 |
| 2,891,461 | 6/1959 | O'Day | 98/40.13 |
| 2,928,331 | 3/1960 | Averill | 98/40 |
| 2,947,237 | 8/1960 | O'Day | 98/40 |
| 2,994,259 | 8/1961 | O'Day | 98/40 |
| 3,053,164 | 9/1962 | Lyttle et al. | 98/40.13 |
| 3,107,597 | 10/1963 | Person | 98/40.13 |
| 3,205,809 | 9/1965 | Sweeney et al. | 98/40.13 |
| 3,311,044 | 3/1967 | Marino | 98/40.13 |
| 3,765,136 | 10/1973 | Skoch | 98/40.05 |
| 3,854,386 | 12/1974 | Hedrick | 98/40 |
| 4,020,752 | 5/1977 | Stephan | 98/40 |
| 4,080,882 | 3/1978 | Brums | 98/40 |

FOREIGN PATENT DOCUMENTS

| | | | |
|---|---|---|---|
| 965409 | 7/1964 | United Kingdom | 98/40.13 |

*Primary Examiner*—Albert J. Makay
*Assistant Examiner*—Steven E. Warner
*Attorney, Agent, or Firm*—Richards, Harris, Medlock & Andrews

[57] ABSTRACT

An air diffuser (10) is disclosed which has the significant advantage of employing only three subassemblies at the point of installation, including a base (12), a cone assembly (14) and a single bolt (16) to fasten the subassemblies together. Contoured rods (26, 28) are mounted with the base (12) to receive channels (48) on a series of brackets (46) to align the cone assembly and base. The brackets (46) forming the channels (48) also perform the function of securing a middle and lower diffuser cone together. A method of manufacture is also disclosed.

6 Claims, 18 Drawing Figures

FIG. 3
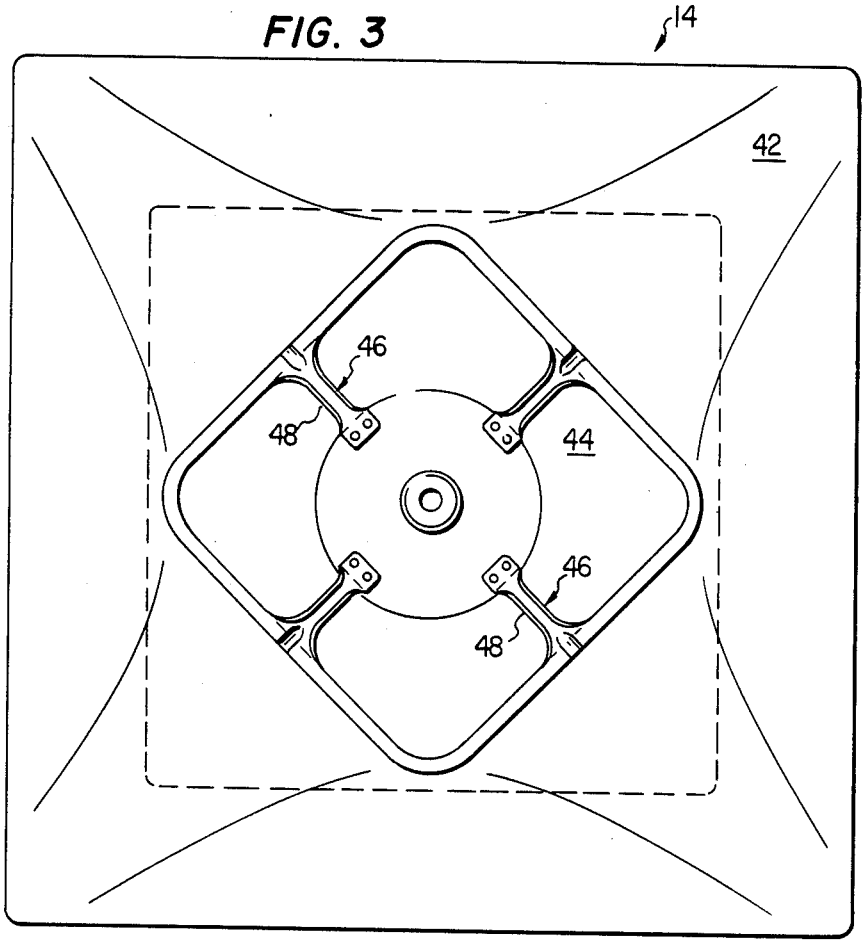
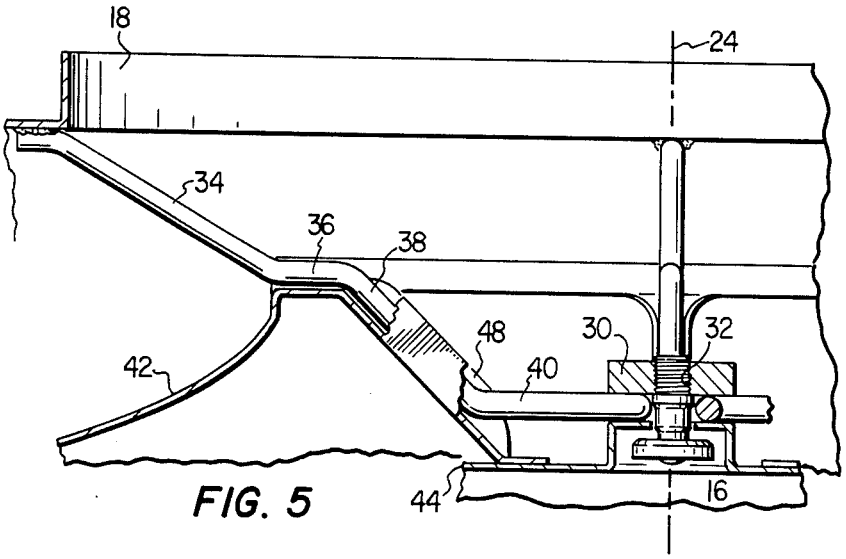
FIG. 5

CEILING AIR DIFFUSER

TECHNICAL FIELD

This invention relates to the heating and ventilation industry, and particularly to an improved air diffuser design for diffusing conditioned air into a room.

BACKGROUND ART

One of the most challenging problems in maintaining a conditioned living space is the distribution of conditioned air throughout the room. The distribution should avoid causing a draft and should provide a uniform air temperature throughout the room.

Since most conditioned air is provided to a room through a duct, diffusers have been developed to distribute the conditioned air from the duct throughout the room. Samples of such diffusers include U.S. Pat. Nos. 3,053,164 to Lyttle and 3,765,316 to Skoch.

While previous air diffuser designs have been effective, they remain relatively complex constructions which require a significant effort in assembly and installation. A need exists to develop a diffuser structure which minimizes assembly time and effort, provides for efficient installation, is constructed for the minimum cost and yet remain effective in diffusing conditioned air throughout a room.

SUMMARY OF THE INVENTION

An air diffuser is provided for diffusing conditioned air from a duct to a room. The air diffuser includes a base having an inlet portion for attachment to the duct. An air passage is defined through the base for flow of the conditioned air therethrough when the base is connected to the duct. A cone assembly is provided for diffusing air passing through the air passage in the base into the room when the cone assembly is positioned in a selected orientation to the base. The base includes a cone assembly suspension extending into the air passage. Structure is provided for attaching the cone assembly to the cone assembly suspension at a single point. Structure is also provided on the cone assembly for aligning the cone assembly in the selected orientation with the base as the cone assembly is attached to the suspension.

In accordance with another aspect of the present invention, the suspension is formed by rods extending from the base into the passage and intersecting at the passage center line. Structure can be provided for securing the rods together at the passage center line. The structure for aligning the cone assembly in the selected orientation with the base can comprise channels mounted on the cone assembly to receive the rods in the selected orientation.

In accordance with yet another aspect of the present invention, a method for manufacturing an air diffuser is disclosed. The method includes the step of forming a base having a diffuser cone and an inlet portion. A step is also provided for forming a first diffuser cone with a diffuser portion having an opening in its center and a plurality of brackets being formed extending into the opening from the diffuser portion. The method further includes the step of forming a second diffuser cone having a diffuser portion and an attachment portion to attach the brackets of the first diffuser cone thereto. The diffuser cone of the base can be formed with dimples for orienting rods for welding thereto.

BRIEF DESCRIPTION OF THE DRAWINGS

For a more complete understanding of the present invention, reference is now made to the following description taken in conjunction with the accompanying drawings, in which:

FIG. 3 is a top view of the cone assembly;

FIG. 5 is a partial cut away side view of the air diffuser illustrating the cooperation of the channels and suspension rods;

DETAILED DESCRIPTION

Figure 1:
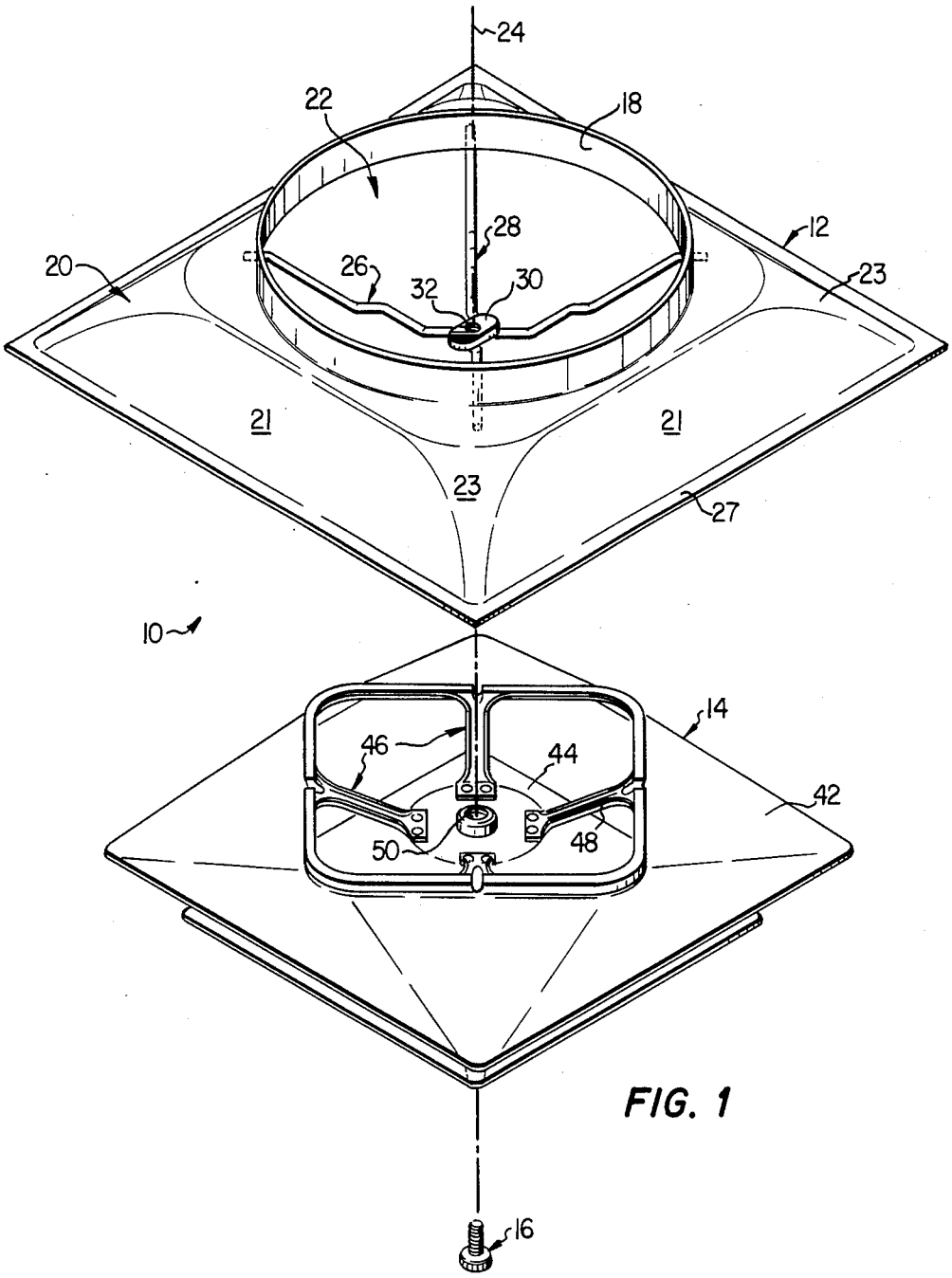
FIG. 1 is an exploded assembly view of an air diffuser forming a first embodiment of the present invention.
Figure 2:
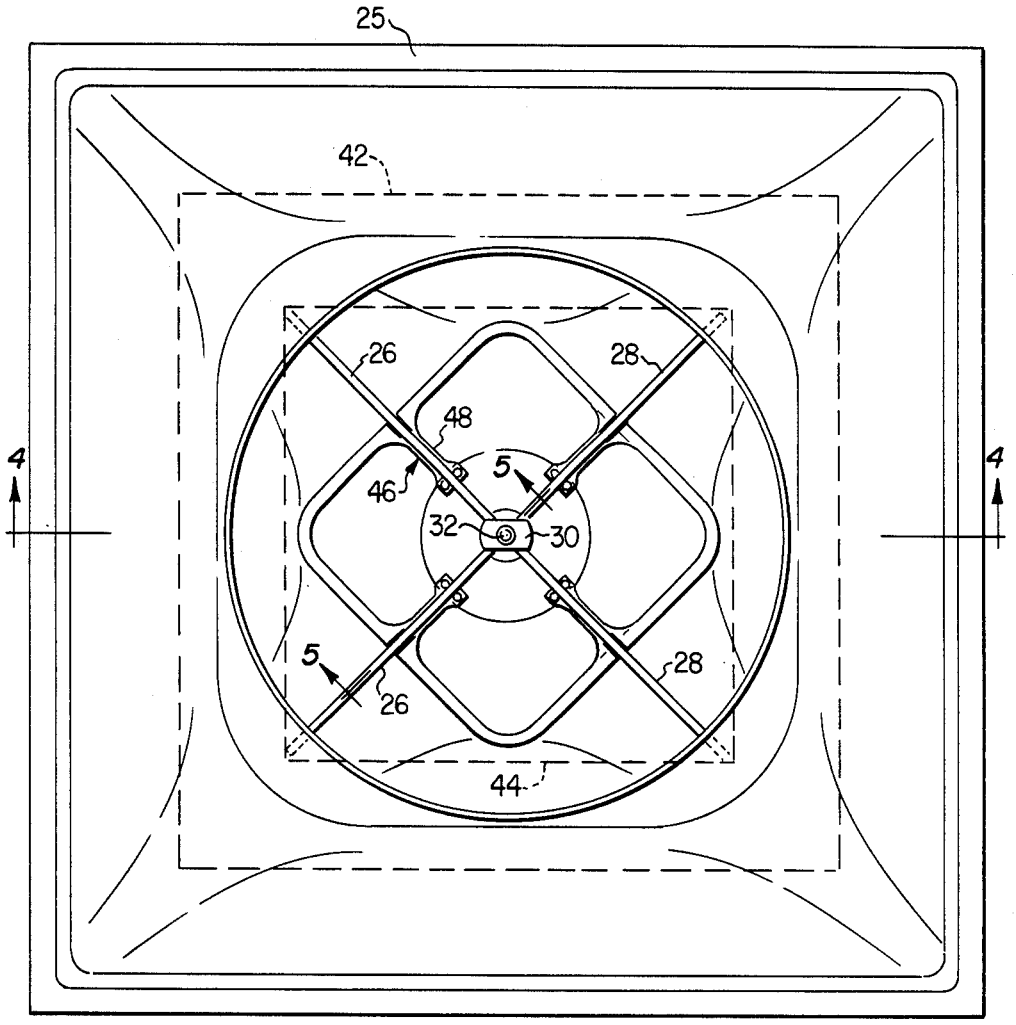
FIG. 2 is a top view of the assembled air diffuser.

Referring now to the drawings, wherein like reference numerals designate like or corresponding parts throughout the several views, and in particular to FIG. 1, an air diffuser 10 is illustrated forming the first embodiment of the present invention. The air diffuser 10 is intended for use as a ceiling air diffuser, but can clearly be readily adapted for use in other diffuser environments.

A significant advantage of the air diffuser of the present invention is the reduction in the number of parts used in the construction of the air diffuser and the simplicity of installation of the air diffuser on site. The exploded view of FIG. 1 illustrates the air diffuser 10. Typically, it would be shipped from the factory as an assembled unit and generally would be installed directly on site without disassembly. However, the installer at the site can disassemble the diffuser into the subassemblies as shown in FIG. 1 for installation.

As is evident, the air diffuser comprises only three separate subassemblies, a base 12, a cone assembly 14 and a threaded bolt 16. The base 12 has a cylindrical inlet portion 18 for attaching the base to the open end of a conventional duct (not shown) through which conditioned air flows. Clearly, inlet portion 18 is designed to be secured to the end of the circular duct. However, inlet portion 18 can have whatever configuration is needed for engagement with the air duct used. An upper diffuser cone 20 is also part of base 12 and has a generally square configuration perpendicular the air flow direction. A passage 22 is defined through inlet portion 18 and cone 20 which has a center line 24. Preferably, the center line 24 coincides with the center line of the passage through the air duct where it mates with the air diffuser 10. The cone 20 has four walls 21 angled outward from inlet portion 18, defining four corners 23 where the walls intersect. A continuous lip 27 is formed about the outer peripheries of walls 21 and extending perpendicular to axis 24 to provide attachment points to a ceiling or wall. Usually the length of lip 27 along a wall will rest on one side of the T-bar of a suspended ceiling, with the lengths on opposite walls resting between parallel T-bars of the ceiling.

Figure 4:
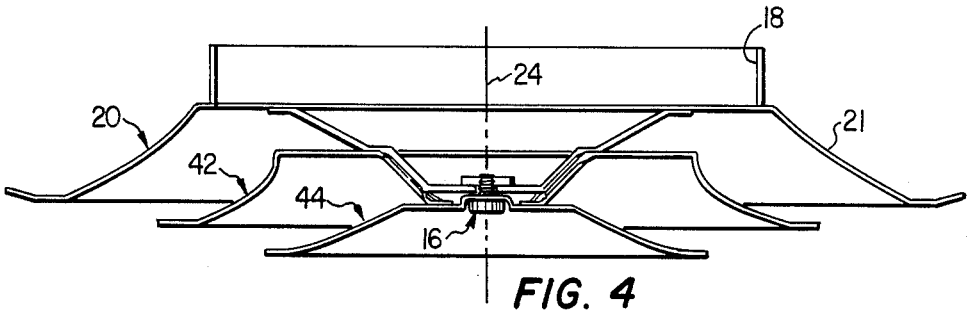
FIG. 4 is a cross sectional side view of the assembled air diffuser.
Figures 6A, 6B, 6C:
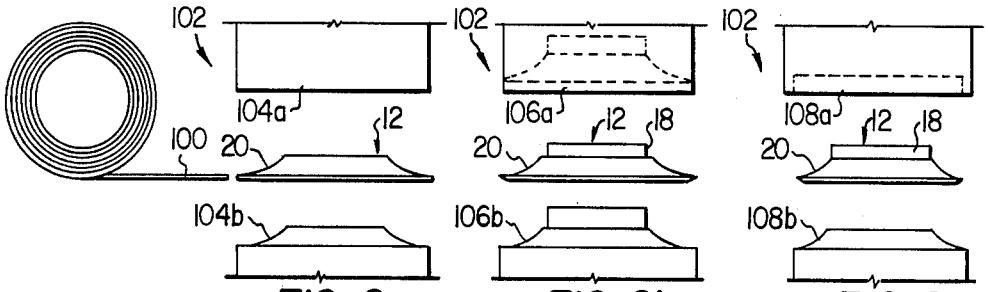
FIGS. 6*a–f* illustrate the method of manufacturing the base of the air diffuser.
Figures 6D, 6E, 6F:
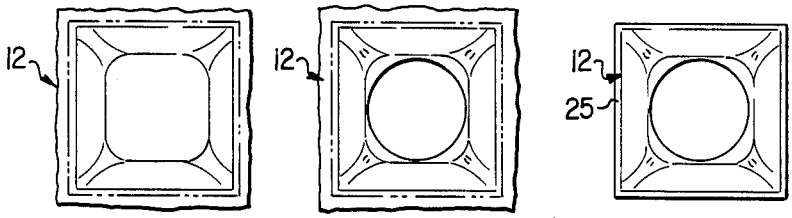
Figures 7A, 7B:
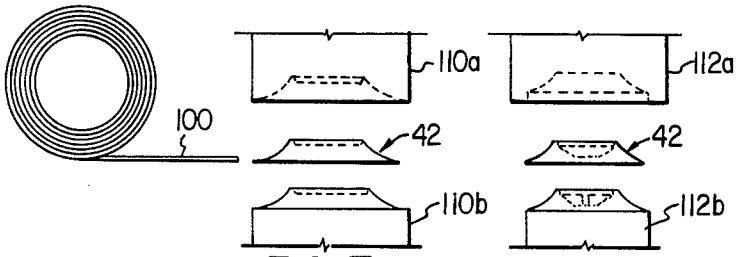
FIGS. 7*a–d* illustrate the method of manufacturing the middle diffuser cone of the air diffuser.
Figures 7C, 7D:
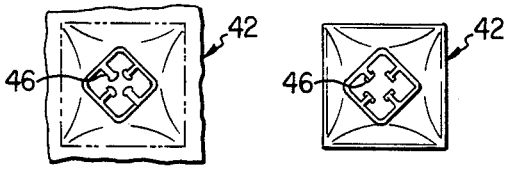
Figure 8A:
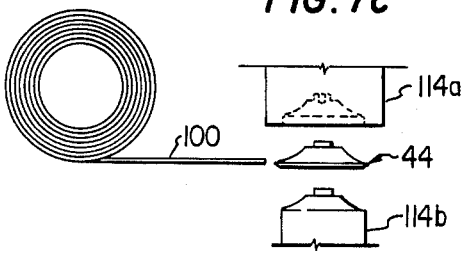
FIGS. 8*a–b* illustrate the method of manufacturing the lower diffuser cone.
Figure 8B:
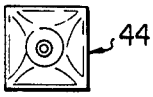
Figure 9:
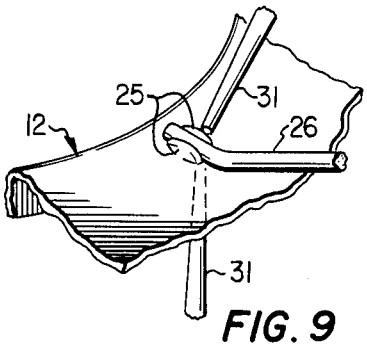
FIG. 9 illustrates the dimples formed on the base to receive the rods for welding.

A pair of contoured rods 26 and 28 are fastened at their ends to diffuser cone 20 as best seen in FIGS. 1, 4 and 5. In the embodiment disclosed, an end of each rod is secured to the cone 20 at a corner 23 of the cone 20 (as by welding) and extends inward toward the center line 24, where it then bends a 90° angle for the opposite end of the rod to be attached to the cone 20 at an adjacent corner 23. Dimples 25 (as seen in FIG. 9) are formed in cone 20 at the corners 23 to orient the rods on the cone for welding (as by welding rods 31). A bracket 30 is fastened between the rods 26 and 28 at the center line and defines a threaded aperture 32 centered on center line 24. As best seen in FIG. 5, each of the rods 26 and 28 is contoured with an upper inclined section 34 extending toward center line 24 at an angle less than 90°, an upper horizontal section 36 extending toward center line 24 perpendicular to the center line, a lower inclined section 38 again extending toward the center line 20 but at less than a right angle thereto and a lower horizontal section 40 extending perpendicular center line 24 to which bracket 30 is attached (as by welding).

The cone assembly 14 is comprised of a middle diffuser cone 42, a lower diffuser cone 44 and four brackets 46 which interconnect cones 42 and 44. Brackets 46 are preferably integral with cone 42 and are secured to the cone 44 by any method desired, including rivets, as shown. Each of the cones 42 and 44 has a square shape corresponding to cone 20, but is of progressively smaller dimensions. The cones are intended to nest together in a selected orientation, as best seen in FIG. 4, to diffuse the conditioned air from the air duct into a room.

The brackets 46 have channel sections 48 which open toward rods 26 and 28 when the air diffuser is assembled. The lower inclined sections 38 of the rods are received in the channels 48 to orient the cone assembly 14 in the selected orientation with the base 12 about axis 24 to insure all the corners of the cones are aligned. The top of cone 42 also rests against upper horizontal section 36 to properly space the cones apart, as best seen in FIG. 4. The threaded bolt 16 is used to hold the air diffuser together and the threaded portion of the bolt passes through an opening 50 on the center line of the lower diffuser cone 44 to threadably engage the bracket 30 while the head of the bolt is received within a recess in the lower diffuser cone 44. The rods 26 and 28 and channels 48 can be understood to extend radially outward from the axis 24 at the same angle to fit closely together.

It can readily be understood that the air diffuser 10 is formed of very few components, thus reducing forming costs and assembly costs. While it is common for prior design diffusers to have as many as 36 separate pieces entering into the construction of the diffuser, the present invention, as embodied by air diffuser 10, includes only seven separate pieces, of which a number are duplicates. In the factory, these parts are assembled into the three discrete subassemblies described above, base 12, cone assembly 14 and bolt 16. Typically, the subassemblies are assembled at the factory, but they can be assembled or reassembled at the site of installation, as needed. The assembler need only take the base 12, place the cone assembly 14 in a position so that the channels 48 align with the rods 26 and 28 to properly orient the cones and fasten the diffuser together with the bolt 16.

With reference now to FIGS. 6–9, the preferred method of manufacture of the major components of air diffuser 10 will be described. These major components, including the base 12 and the cone assembly 14, are formed in a press by various dies from rolls of flat sheet stock 100.

With particular reference to FIGS. *6a–f*, the forming of base 12 will be described. The base 12 is formed in three stages within the press 102 between die sets 104, 106 and 108. At the first die set, the upper die **104*a* will be moved downward by conventional structure within the press into contact with the lower die 104*b* with a section of the roll of sheet stack 100 therebetween. Die set 104 forms the upper diffuser cone 20 and shears the base 12 being formed from the remainder of the roll of sheet stack 100. Conventional press transfer devices move the base 12 from die set 104 between the die set 106. Upper die 106*a* will come down onto lower die 106*b* with the base 12 therebetween to form the cylindrical inlet portion 18. In addition, die set 106 will form the dimples 25 at the corners 23 of the upper diffuser cone 20. Again, conventional transfer structure will move the base 12 between the third die set 108 where final trimming of lip 27** is performed.

FIGS. *7a–d* illustrate the method for manufacturing the middle diffuser cone 42. Again, the cone 42 is formed from a roll of sheet stock 100. The sheet stock is fed between die set 110 in the press 104 which forms the diffuser cone shape and cuts out the open center portion thereof with sufficient material left to form the brackets 46. After forming with die set 110, the cone 42 is transferred to die set 112 where the brackets 46 are formed with their channel shape and deformed downward to the final contour shape.

FIGS. *8a* and *8b* illustrate the forming of the lower diffuser cone 44. Again cone 44 is formed from a roll of sheet stock 100 which is fed between a die set 114 in the press 102. The cone 44 is formed in a single die formation step with the die set 114.

While one embodiment of the invention has been illustrated in the accompanying drawings and described in the foregoing Detailed Description, it will be understood that the invention is not limited to the embodiment disclosed, but is capable of numerous rearrangements, modifications and substitutions of parts and elements without departing from the spirit of the invention.

We claim:

1. An air diffuser for diffusing conditioned air from a duct to a room, comprising:

a base having an inlet portion for attachment to the duct, an air passage having a center line being defined through the base for flow of the conditioned air therethrough when the base is connected to the duct;

a cone assembly for diffusing air passing through the air passage in the base into the room when positioned in a selected orientation to the base;

said base including a cone assembly suspension being formed by at least one rod extending into the air passage to proximate the center line;

means for attaching said cone assembly to said suspension at a single point; and a cone alignment assembly comprising a channel formed on the cone assembly to receive a portion of said rod to align the cone assembly with the base.

2. The air diffuser of claim 1 wherein said suspension comprises two contoured rods and said base has means for securing the rods together at the center line of the passage.

3. The air diffuser of claim 1 wherein said cone assembly includes first and second contoured diffuser cones and said means for attaching said cone assembly to said suspension at a single point includes structure contoured to nest the first and second cones partially within the air passage through the base.

4. The air diffuser of claim 1 wherein said cone assembly suspension extends into the air passage to the center line of the passage and has a threaded aperture on the center line, said means for attaching said cone assembly to the suspension at a single point comprising a threaded bolt for being received in the threaded aperture of the suspension.

5. An air diffuser for diffusing conditioned air from a duct to a room, comprising:

a base having an inlet portion for attachment to the duct and a diffuser cone, an air passage having a center line being defined through the base for flow of the conditioned air therethrough when the base is connected to the duct, the diffuser cone having a noncircular configuration in a plane perpendicular. the center line of the passage;

a cone assembly having at least one diffuser cone for diffusing air passing through the air passage in the base into the room when the cone assembly is positioned in a selected orientation to the base;

said base including a cone assembly suspension comprising a pair of contoured rods extending proximate the center line of the passage and a bracket connecting the rods at the center line, said bracket having a threaded aperture centered on the center line of the passage;

said cone assembly being aligned in the selected orientation by at least one channel to receive a portion of a rod to properly orient the cone assembly relative to the base about the center line of the passage and space the cone assembly along the center line axis from the base in the selected orientation; and means for attaching said cone assembly in the selected orientation to said suspension at a single point on the center line.

6. An air diffuser for diffusing conditioned air from a duct to a room comprising:

a base having an inlet portion for attachment to the duct and a diffuser cone, said base defining an air passage having a center line therethrough for flow of the conditioned air when the base is connected to the duct, the diffuser cone having a generally square configuration with four outwardly flared walls ending in a lip about the periphery for attachment to a surface;

a cone assembly having first and second cones interconnected by a plurality of brackets, each of said diffuser cones having a generally square configuration for partial nesting within the cone of the base, the cone assembly having an axis of symmetry with said plurality of brackets extending along radii from the axis of symmetry between the first and second diffuser cones, each of said brackets having a channel portion opening toward the base when nested;

said base including a cone assembly suspension including first and second contoured rods, each of said rods being fastened at its ends to adjacent corners of the diffuser cone on the base and extending proximate the center line of the passage and a bracket interconnecting the first and second rods at the center line and defining a threaded aperture therethrough concentric the center line;

the channels receiving portions of the rods therein to position the cone assembly relative to the base with the corners of the diffuser cones aligned, the cone assembly and base being secured together by a threaded bolt received through the cone assembly and threaded into the bracket of the base.

* * * * *